US005997792A

United States Patent [19]

Gordon

[11] Patent Number: 5,997,792

[45] Date of Patent: Dec. 7, 1999

[54] APPARATUS AND PROCESS FOR CASTING LARGE CONCRETE BOXES

[75] Inventor: Harry Gordon, Richmond, Canada

[73] Assignee: TWIC Housing Corporation, Columbia, Canada

[21] Appl. No.: 08/786,858

[22] Filed: Jan. 22, 1997

[51] Int. Cl.[6] ..... B28B 7/22

[52] U.S. Cl. ..... 264/219; 249/22; 249/74; 249/192; 249/194; 264/299; 264/309; 264/334

[58] Field of Search ..... 264/219, 261, 264/299, 309, 334; 249/22, 66.1, 74, 192, 193, 194

[56] References Cited

U.S. PATENT DOCUMENTS

| | | | |
|---|---|---|---|
| 3,793,428 | 2/1974 | Gordon | 264/250 |
| 3,853,452 | 12/1974 | Delmonte | 249/22 |
| 3,934,808 | 1/1976 | Aizawa | 249/152 |
| 4,252,293 | 2/1981 | Daley | 249/74 |
| 4,447,035 | 5/1984 | Ivey et al. | 249/194 |
| 5,376,315 | 12/1994 | Fricke | 264/334 |
| 5,643,488 | 7/1997 | Lee | 249/192 |
| 5,755,982 | 5/1998 | Strickland et al. | 249/74 |

*Primary Examiner*—Jill L. Heitbrink
*Attorney, Agent, or Firm*—Fish & Richardson P.C.

[57] ABSTRACT

A method of forming concrete integral box shaped modules provides dimensional accuracy and sustains closer tolerances thus permitting surfaces of adjacent modules to match. The method utilizes a standard fixed box frame with vertical walls that can be easily reset after forming a module. The method includes the steps of constructing a fixed box form with four vertical rectangular sides and a top horizontal surface, top trays extending out from top edges of the rectangular sides and bottom trays extending out from bottom edges. Corner fillers are placed in vertical corner spaces formed by the four vertical sides, steel mesh and rebar is laid on the vertical sides and in the trays, the trays are then filled with concrete and concrete is sprayed onto the vertical sides. The module is steamed to set the concrete, the trays are removed and the module is raised initially by jacking to release the module from the box form.

26 Claims, 5 Drawing Sheets

APPARATUS AND PROCESS FOR CASTING LARGE CONCRETE BOXES

TECHNICAL FIELD

The present invention relates to building construction and more specifically to a method and an apparatus for forming a concrete integral box shaped module having four rectangular side walls surrounding a rectangular end wall.

BACKGROUND OF INVENTION

Building construction using box shaped modules made of concrete has certain advantages over more conventional building methods because the prefabrication of the modules can be formed in either a factory or on one specific location at a building site and thus tolerances can be more easily controlled. The concrete building modules, sometimes referred to as "tubes", generally consist of a ceiling surface, floor surface and two or three wall surfaces. In some cases the end wall is omitted providing an open tube module and in other cases the end wall is provided having a closed tube module. The concrete module has all the necessary structural elements such as joists, beams, posts, etc. integrally formed therein, and provides a cubic space suitable for a single room or multiple rooms. Dimension limits are defined by what can be manufactured in practice, what maximum weight can be handled and what dimensions can be transported.

Concrete building modules are formed on formwork. Reinforcing in the form of mesh is generally first applied around the formwork and then concrete is sprayed in a manner sometimes referred to under the trademark "SHOTCRETING" so that thin layers of dense concrete cover vertical surfaces. Horizontal concrete surfaces are formed in the conventional manner. When concrete is sprayed onto a smooth steel surface it produces one smooth dense concrete surface that needs minimal cosmetic treatment. This is an inner surface of the building module.

The formwork presently used for forming concrete boxes or modules has to either have tapered sides to permit the concrete box to be removed or, alternatively, the formwork must be collapsible. The formwork is not ideal with tapered sides, as the inside surfaces of the concrete module are not completely level or matched. The problems with a collapsible framework is the loss of accuracy that occurs between modules when matching surface edges. The collapsing and resetting of the framework results in dimension changes from cast module to cast module.

SUMMARY OF THE INVENTION

We have now found that a fixed box shaped formwork can be used with four vertical walls having no taper therein and a top horizontal surface that can be used to form a concrete end wall. The box form does not have to be reset after each module is formed. This provides dimensional accuracy in concrete modules, they can be made and sustained to closer tolerances than modules made on collapsible forms. The four smooth vertical sides of the box form are coated with a "release" coating to produce four vertical smooth walls of a concrete module and when the module is used these four vertical walls become a ceiling, a floor and two side walls. If a concrete end wall is formed on the top horizontal surface of the box form, it becomes the end wall when the concrete module is in place.

The concrete modules are formed by first of all surrounding the "release" coated vertical sides of the box form with a reinforcing steel mesh and then spraying concrete with conventional spraying equipment onto the four vertical sides of the form. This provides an enclosed room module with thin lightweight and reinforced walls, smoothly finished on the inside and roughly finished on the outside. The smooth inside surface can be used as an interior wall surface or can have drywall or other surface finishes placed thereon.

The box form may have frames inserted for windows, doors, openings and the like, before concrete spraying. Furthermore, conduits for electrical power lines, water pipes and other services may be placed around the box form before forming the concrete module.

The present invention provides a method of forming a concrete integral box shaped module having four rectangular side walls surrounding a rectangular end wall, comprising the steps of: constructing a fixed box form, having four vertical rectangular sides and a top horizontal surface; positioning top trays extending out from top edges of the four rectangular sides, and bottom trays from bottom edges of the four rectangular sides; placing corner fillers at vertical corner spaces formed by the four vertical sides leaving a vertical gap at each corner between two adjacent vertical sides; laying reinforcing steel mesh and rebar on the top horizontal surface, the top trays, the bottom trays and against the four vertical sides; filling the bottom trays with concrete to form lower lips extending out from bottom edges of the side walls of the module; spraying concrete on the reinforcing steel mesh and rebar on the four vertical sides to form the side walls of the module; filling the horizontal surface of the box form and the top trays with concrete to form the end wall, with upper lips extending out from top edges of the side walls of the module; steaming the module on the box form to set the concrete; removing the top trays from the module, and removing the module from the form by lifting, and at the same time jacking up the lower lips of the module to separate from the bottom trays.

The present invention also provides a box form for forming a concrete integral box shaped module having four rectangular side walls, the box form comprising: four fixed vertical rectangular sides with a top horizontal surface forming a box shape with vertical gaps between adjacent rectangular sides forming vertical corner spaces; bottom trays extending out from bottom edges of the four rectangular sides, the bottom trays having removable plates therein for positioning lifting jacks thereunder; removable corner fillers positioned in the vertical corner spaces, and removable top trays connectable to top edges of the four rectangular sides.

BRIEF DESCRIPTION OF THE DRAWINGS

In drawings which illustrate embodiments of the present invention.

BEST MODE FOR CARRYING OUT THE INVENTION

Figure 1:
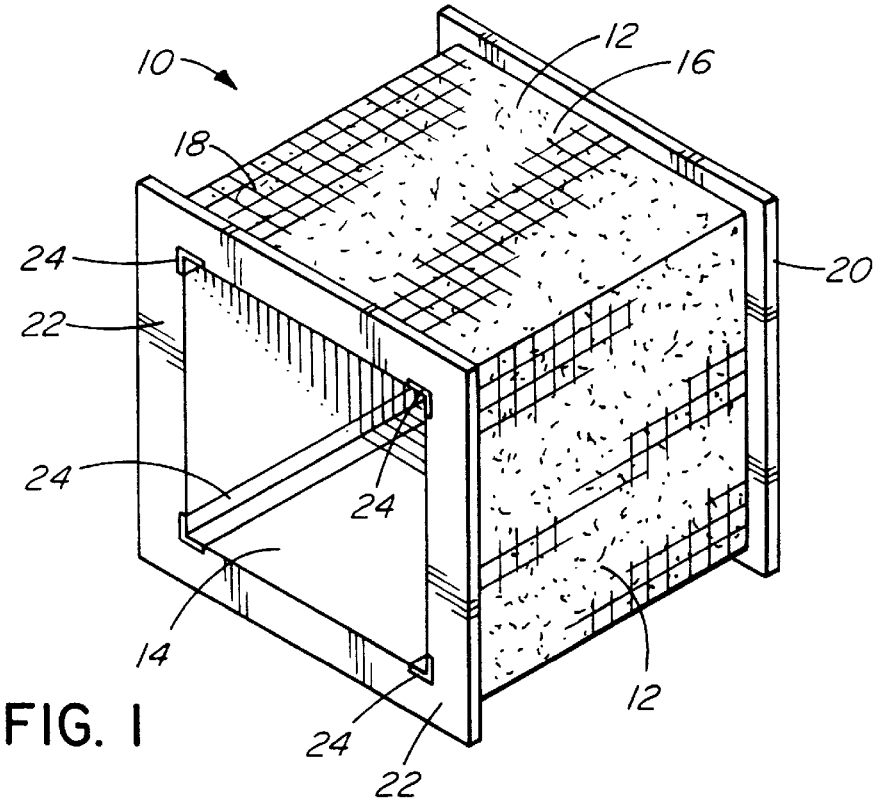
FIG. 1 is an isometric view showing a concrete integral box shaped module formed by the method of the present invention.

A concrete integral box shaped module 10 is shown in FIG. 1 with four rectangular side walls 12. In effect the side walls 12 become a ceiling, two side walls and a floor when the module is used in a building. The module 10 may have an end wall 15 which may be seen in FIGS. 8 and 9 to make it a closed box or may have no end wall to make a tube. The interior surfaces 14 of the side walls 12 are smooth and the exterior surfaces 16 of the side walls are shown as rough but may be smoothed by trowelling if desired. A reinforcing steel mesh 18 which is visible on the outside of the side walls, is covered by layers of concrete. Top lips 20 are shown extending around what is referred to as the top edge of the side walls 12. Similarly bottom lips 22 are shown extending around the bottom edges of the side walls 12. The surfaces of the top lip 20 and the bottom lip 22 are smooth as they are formed by concrete placed in tray forms. Four corner fillers 24 in the form of angles are shown in the interior corners of the module 10 between adjoining side walls 12.

Figure 2:
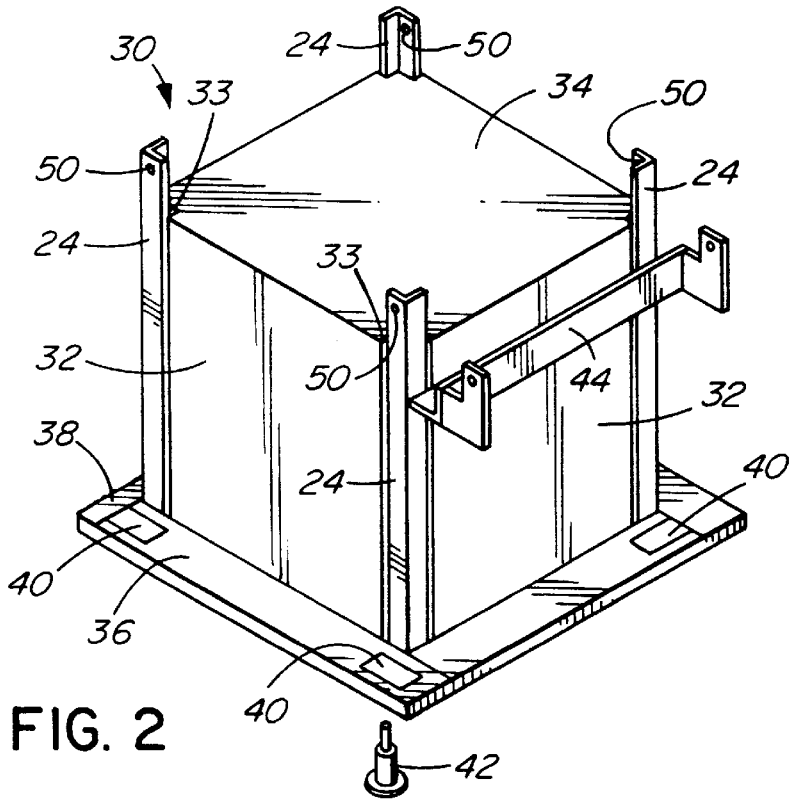
FIG. 2 is an isometric view showing a box form for forming a concrete integral box shaped module as shown in FIG. 1.
Figure 5:
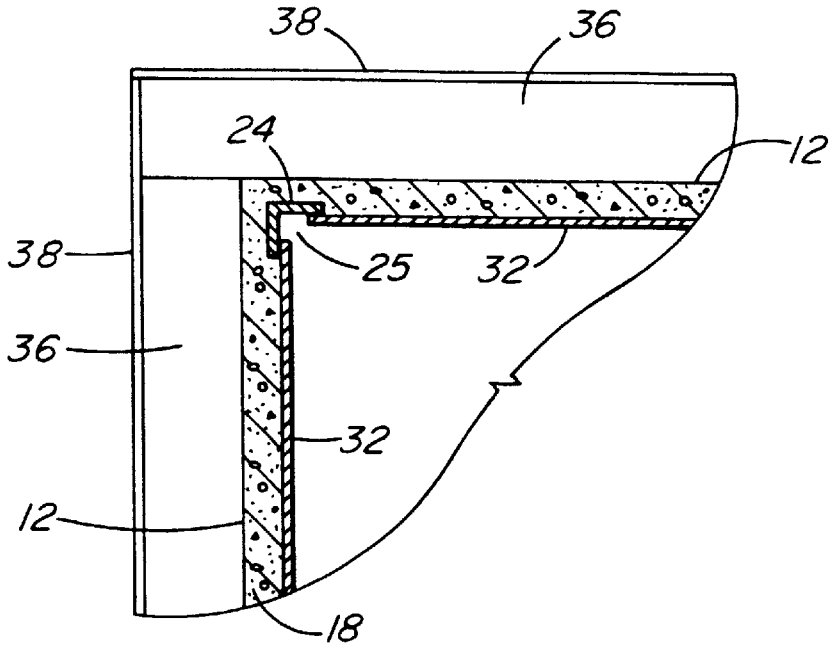
FIG. 5 is a detailed sectional view of a vertical corner of a concrete module on a box form showing one type of reinforcing corner filler for a concrete module.

A box formwork 30 is shown in FIG. 2 having four vertical sides 32 made from steel plate and having a non-friction coating to prevent the concrete sticking. The sides 32 do not join at the corners but have a small vertical gap 25 between adjacent vertical sides 32 as shown in FIG. 5. In a preferred embodiment, the vertical gap 25 is at least about ¼ inch. The vertical sides 32 are not tapered inwards. Corner fillers 24 are separate from the box form 30 and are inserted into vertical corner spaces 33 to cover the vertical gaps 25 before fabricating a concrete module. A top horizontal surface 34, generally another steel plate, extends between and attaches to the four sides 32 to complete the box form 30. Bottom trays 36 extend out from the bottom edges of the sides 32. The bottom trays 36 have a flange 38 to contain concrete which is placed in the trays 36. Four loose steel plates 40 are shown positioned in the corners of the bottom trays 36 and a jack 42 are shown positioned beneath the plates 40. The jack 42 is used to raise each plate which in turn separates the concrete module 10 from the box form 30 after curing, as will be explained. The bottom trays may be removable.

Top trays 44 are provided at the top edges of sides 32. Whereas the drawing shows only one tray, four top trays 44 are provided, one for each side 32. The ends of the top trays 44 meet to form a continuous tray around the four sides 32. Each top tray has a pivot 46 so that the tray can be swung aside.

Figure 3:
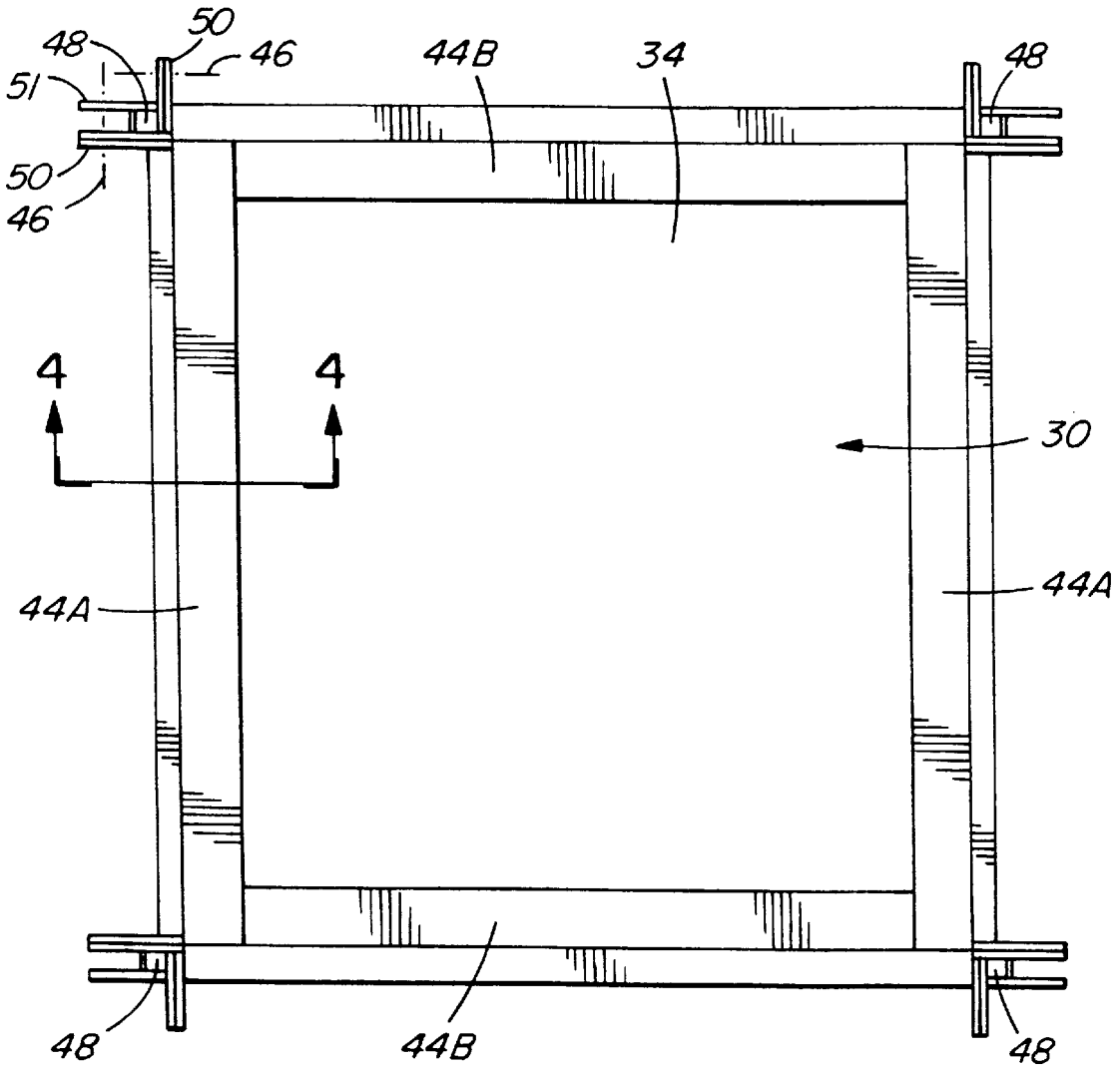
FIG. 3 is a plan view showing a box form similar to that shown in FIG. 2.
Figure 4:
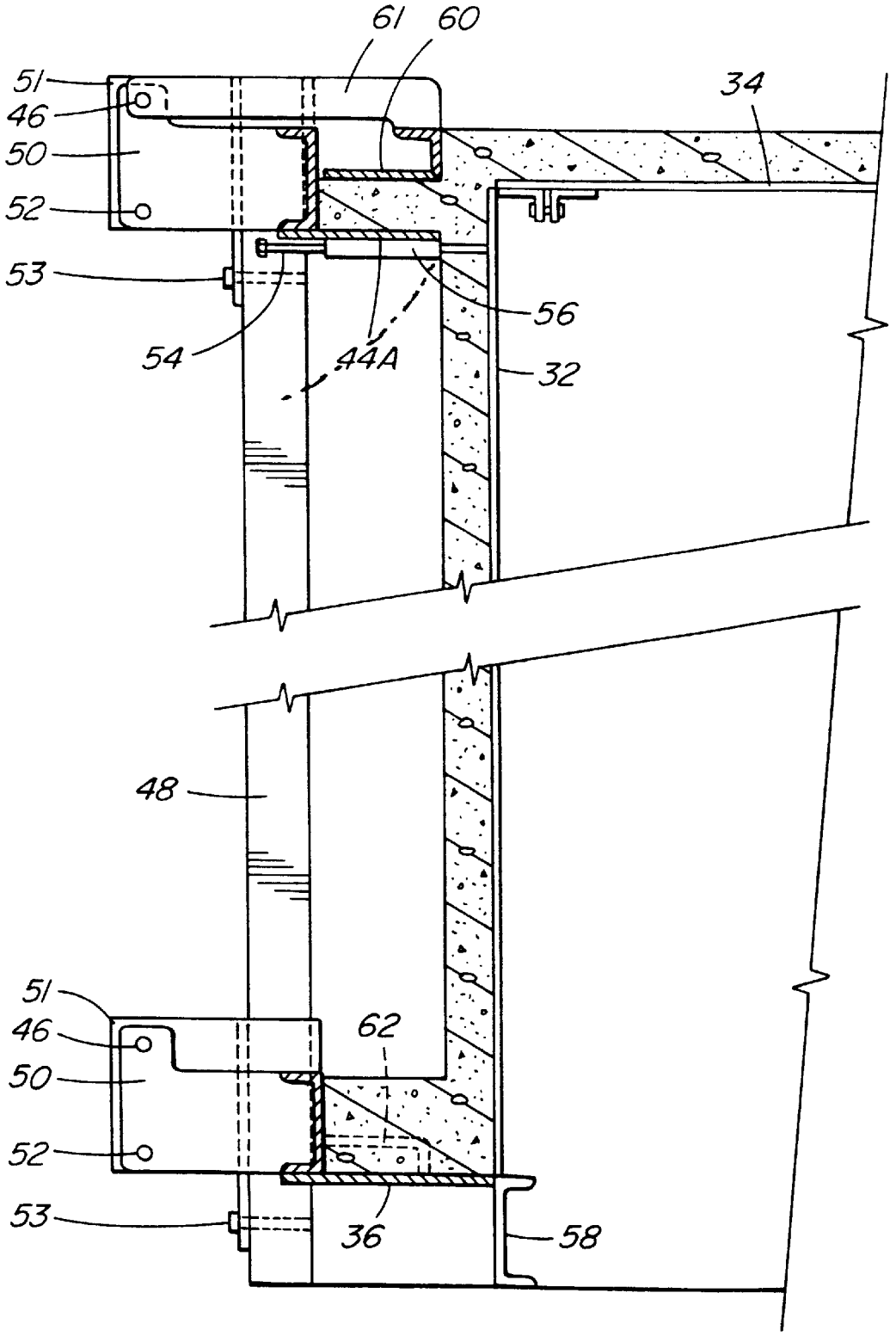
FIG. 4 is a detailed sectional view taken at line 44 of FIG. 3.

A top plan view of a box form 30 is shown in FIG. 3 with opposing top trays 44A held up by posts 48. The two other opposing top trays 44B are also supported by the posts 48. As shown in FIG. 4, a bracket 50 attached to top trays 44A and 44B connects the tray 44A to sleeves 51 which slide up and down on posts 48. A pivot pin 46 extends through the top hole in the bracket 50 and a lock pin 52 extends through the bottom hole. To remove the top trays 44A and 44B, the lock pins 52 are removed, the bracket 50 swings down along chain dotted line shown and is clear of the concrete module so it can be raised up. The sleeves 51 can be raised and lowered on posts 48 and are locked in place by sleeve locator pins 53.

Bottom trays 36 are shown mounted to post 48 at the bottom edge of side 30. A bracket 50, similar to that used with top trays 44A and 44B has a pivot pin 46 to support the bracket and locking pins 52 to lock the bracket in place.

Beneath the top trays 44A and 44B is a threaded setting bolt 54 passing through a threaded pipe 56 attached to the trays 44A and 44B. The setting bolt 54 permits exact location of the trays 44A and 44B against the sides 32 before the concrete is sprayed to form the walls. The setting bolt 54 arrangement may also be used for exactly positioning the lower trays 36. Preferably each tray has two setting bolts 54. The complete box form 30 is shown sitting on a foundation frame 58 in FIG. 4.

In some instances it is necessary to space the upper lip 20 down from the top surface of the module and in this case a top angle member 60 shown in FIG. 4 extends along the top of the top trays 44A and 44B and has a pivot arm 61 which connects to the pivot pin 46. When concrete is poured, the top angle member 60 sets the edge of concrete for top concrete panel.

A bottom angle member 62 is shown in dotted lines in FIG. 4 which permits the lower lip 22 to be spaced up from the bottom edge of the walls 12. The bottom angle member 62 performs the same function as the top angle member 60.

Figure 6:
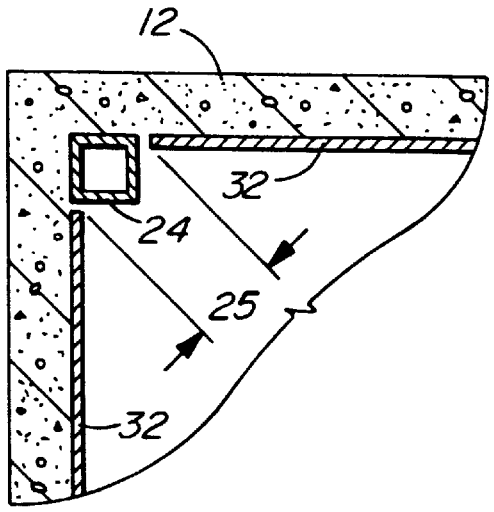
FIG. 6 is a detailed sectional view similar to FIG. 5 showing another type of reinforcing corner filler for a concrete module.

The corner filler 24 is shown in FIG. 5 as being an angle overlapping the vertical sides 32. In this form the angle 24 may become integral with the side walls 12 of the concrete module and thus may be used for lifting the module. As shown in FIG. 2, steel angles 24 extend up above the top surface 34 of the form 30 and have lifting holes 50 for attachment to a crane or other type of lifting device. FIG. 6 shows another type of corner filler 24 which is in the shape of a square tube and abuts the vertical sides 32. The embodiment shown in FIG. 6 may permit the corner filler 24 to be embedded in the module 10 and used to lift the module 10. In another embodiment, the corner filler 24 may be removed after the module has been lifted from the box form 30 and replaced into the form 30 for making the next concrete module.

In operation the box form 10 is first of all coated with a release liquid, the top trays 44 and bottom trays 36 are set in position and pinned to the sleeves 51. If the upper lips 20 and the lower lips 22 are to be spaced away from the top and bottom edges of the walls 12, then the top angle members 60 and bottom angle members 62 are placed in position. The corner fillers 24 are placed in position in each corner of the mold 30 and steel reinforcing mesh is installed on all four vertical sides 32, and around the corners over the corner fillers 24.

If precast joists are needed, they are next positioned, and if openings are required in side walls 12 for windows or doors, the forms are placed in the desired positions. Rebar is placed in top and bottom trays 44,36 and if an end wall is required for the module then mesh is placed on the top surface 34 of the mold 30. Spacers are fixed to ensure the mesh and rebars do not touch the surfaces of the mold 30. Setting bolts 56 are adjusted to position trays in exactly the correct position. The end of the setting bolts 54 rests against the vertical sides 32 of the mold 30.

Concrete commences by filling the bottom tray 36, then concrete is sprayed onto all the vertical walls 32 to the required thickness to form side walls 12. In some instances the side walls are approximately 2" thick. After the side walls have been formed the top trays 44 are filled and if an end wall is to be formed, concrete is placed on the top surface 34. After the concrete has been poured, the finished module 10 is covered with an enclosure and steamed so that while the concrete cures it is heated. Steam curing occurs at normal steam curing temperatures, preferably for about 9 hours. After curing, the enclosure is removed, the setting bolts 54 are loosened and the top trays 44A,44B are retracted. If the bottom trays 36 are retractable, these too are retracted. Connections are made to the module for lifting, either connecting chains to connecting holes 50 in the corner fillers 24 or to other connection points on the module for lifting by an overhead hoist. Upward lifting force is applied by the hoist.

A jack 42 is used to push upward on each plate 40 so that the lower lip 22 is pushed up separating the side walls 12 of the module from the sides 32 of the box form 30. Once separation has occurred the module can be lifted by the crane straight upwards and moved away from the box form. The corner fillers 24 in some instances are integral with the module 10 and remain there. Alternatively, they may be separated from the module 10 and returned for installation on the box form 30 for forming a new module. The jack 42 acts to assist in initially dislodging the module 10 from the box form 30. Once this initial movement has occurred the lifting is continued by a crane and chains.

Figure 7:
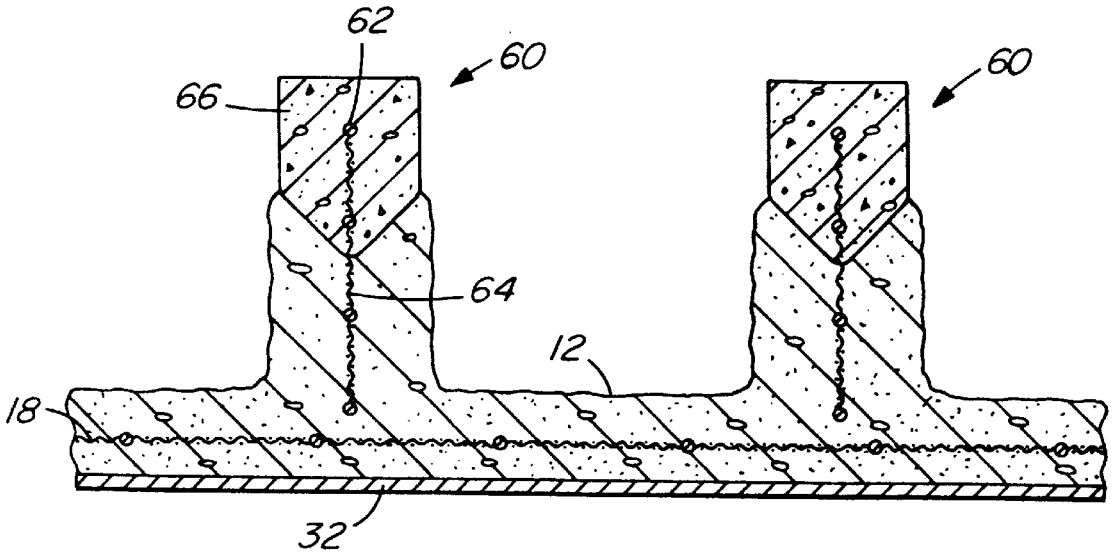
FIG. 7 is a top sectional view through a side wall of a concrete module showing precast joist portions extending vertically down the side walls.

FIG. 7 shows precast joists 60 attached vertically to side walls 12 of the module for increased strength. The precast joists 60 have a rebar 62 connected to a short length of wire mesh 64 and a precast concrete shape 66 enclosing the rebar 62 and a portion of the steel mesh 64. The precast joists 60 are positioned vertically after the reinforcing steel mesh 18 has been located adjacent the vertical sides 32 of the box form 30. Concrete 68 is then sprayed as shown in FIG. 7 to form with the precast concrete sections 66 and thus provide an integral wall and joists. The joists 60 may be spaced at predetermined distances along the side walls 12 of the module.

Figure 8:
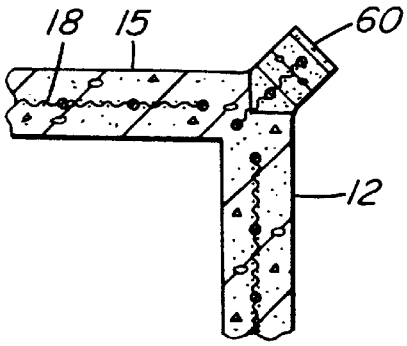
FIG. 8 is a detailed top sectional view showing one corner of a module with an angled joist positioned at the corner.
Figure 9:
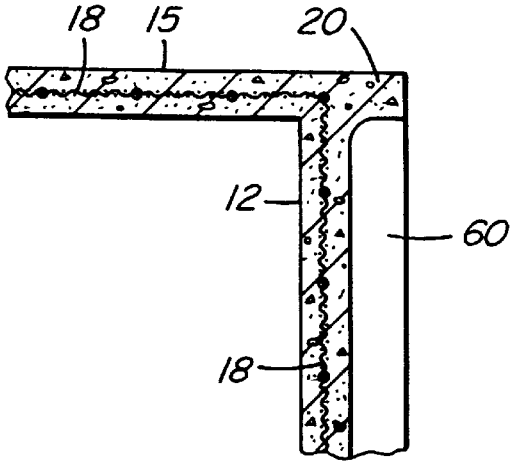
FIG. 9 is a detailed top sectional view similar to that shown in FIG. 8 showing a corner of another module and an intermediate joist on a wall.

FIG. 8 illustrates a corner of one type of module with a floor or ceiling joined to a side wall 12. A precast joist 60 is positioned at a 45° angle to close the space between the module and an adjacent module. FIG. 9 shows precast joists 60 extending vertically down from the upper lip 20 formed integrally with the side wall 12 as shown in FIG. 7.

The corner fillers 24 may be formed of steel or, alternatively, may be a rigid plastic material. The size of the modules may be varied from 10 to 20 ft. wide, 8 to 10 ft. high, and 8 to 12 ft. long. As stated, the window frames, door frames, and other fixtures may be included prior to spraying the concrete walls.

Various changes may be made to the embodiments shown herein without departing from the scope of the present invention which is limited only by the following claims.

I claim:

1. A method of forming a concrete integral box shaped module having four rectangular side walls surrounding a rectangular end wall, comprising the steps of:

constructing a fixed box form, having four vertical rectangular sides and a top horizontal surface with vertical corner spaces at each corner between adjacent vertical sides;

positioning top trays extending out from top edges of the four rectangular sides, and bottom trays from bottom edges of the four rectangular sides;

placing corner fillers at the vertical corner spaces to stabilize the vertical sides and block the corner spaces;

laying reinforcing steel mesh and rebar on the top horizontal surface, the top trays, the bottom trays and against the four vertical sides;

filling the bottom trays with concrete to form lower lips extending out from bottom edges of the side walls of the module;

spraying concrete on the reinforcing steel mesh and rebar on the four vertical sides to form the side walls of the module;

filling the horizontal surface of the box form and the top trays with concrete to form the end wall, with upper lips extending out from top edges of the side walls of the module;

steaming the module on the box form to set the concrete;

removing the top trays from the module, and removing the module from the form by lifting and at the same time jacking up the lower lips of the module to separate from the bottom trays with the corner fillers permitting relative movement of the vertical sides of the form to assist in removal of the module from the form.

2. The method of forming a concrete integral box shaped module according to claim 1 wherein the vertical gap at each corner between two adjacent vertical sides is at least about ¼ inch.

3. The method of forming a concrete integral box shaped module according to claim 1 including the step of forming precast joist portions and attaching the joist portions vertically to the reinforcing steel mesh against the four vertical sides, and including spraying concrete on the reinforcing steel mesh to integrate the precast joist portions with the side walls.

4. The method of forming a concrete integral box shaped module according to claim 3 wherein lifting connections are provided in the joist portions for attaching to lifting means.

5. The method of forming a concrete integral box shaped module according to claim 1 including the step of smoothing the concrete on the horizontal surface of the box form and the top trays to provide a smooth outside surface on the end wall and the upper lips.

6. The method of forming a concrete integral box shaped module according to claim 1 wherein jacking up the lower lips of the module to separate the module from the box form occurs prior to lifting the module.

7. The method of forming a concrete integral box shaped module according to claim 1 wherein jacking plates are provided in the bottom trays, the jacking plates separating from the bottom trays when jacked up to separate the module from the box form.

8. A method of forming a concrete integral box shaped module as claimed in claim 1 wherein the corner fillers are dimensioned to extend above the module and include lifting connections whereby lifting of the form involves connecting lifting means to the lifting connections.

9. A method of forming a concrete integral box shaped module having four rectangular side walls, comprising the steps of:

constructing a fixed box form having four vertical rectangular sides with vertical corner spaces formed between the four vertical sides;

positioning top trays extending out from top edges of the four rectangular sides, and bottom trays from bottom edges of the four rectangular sides;

placing corner fillers at the vertical corner spaces to stabilize the vertical sides and block the corner spaces;

laying reinforcing steel mesh in the bottom trays and against the four vertical sides;

filling the bottom trays with concrete to form lower lips extending out from bottom edges of the side walls of the module;

spraying concrete on the reinforcing steel mesh and rebar on the four vertical sides to form the side walls of the module;

filling the top trays with concrete to form upper lips extending out from top edges of the side walls of the module;

steaming the module on the box form to set the concrete;

removing the top trays from the module; and removing the module from the form by lifting and at the same time jacking up the lower lips of the module to separate from the bottom trays with the corner fillers permitting limited relative movement of the vertical sides of the form to assist in removal of the module from the form.

10. The method of forming a concrete integral box shaped module according to claim 9 wherein the corner fillers are angles which overlap adjoining rectangular sides of the box form.

11. The method of forming a concrete integral box shaped module according to claim 9 wherein the corner fillers are angles which abut adjoining rectangular sides of the box form.

12. The method of forming a concrete integral box shaped module according to claim 9 wherein the corner fillers are made of steel.

13. The method of forming a concrete integral box shaped module according to claim 9 wherein the corner fillers are made of plastic.

14. The method of forming a concrete integral box shaped module according to claim 9 wherein the corner fillers form part of the module.

15. The method of forming a concrete integral box shaped module according to claim 9 wherein the corner fillers are separated from the module after the module is removed from the box form.

16. A box form for forming a concrete integral box shaped module having four rectangular side walls, the box form comprising:

four fixed vertical rectangular sides with a top horizontal surface forming a box shape with vertical gaps between adjacent rectangular sides forming vertical corner spaces;

bottom trays extending out from bottom edges of the four rectangular sides, the bottom trays having removable plates therein for positioning lifting jacks thereunder;

removable corner fillers positioned at the vertical corner spaces to stabilize the vertical sides and block the corner spaces while still permitting limited relative movement of the vertical sides on removal of the module from the form to facilitate separation of the module and form; and removable top trays connectable to top edges of the four rectangular sides.

17. The box form for forming a concrete integral box shaped module according to claim 16 wherein each of the vertical gaps between adjacent rectangular sides is at least about ¼ inch.

18. The box form for forming a concrete integral box shaped module according to claim 16 wherein the removable plates for positioning a lifting jack are placed in corners of the bottom trays.

19. The box form for forming a concrete integral box shaped module according to claim 16 wherein the removable top tray is pivoted to drop away and permit the module to be raised up and disengaged from the box form.

20. The box form for forming a concrete integral box shaped module according to claim 16 wherein the corner fillers are angles which overlap adjoining rectangular sides of the box form.

21. The box form for forming a concrete integral box shaped module according to claim 16 wherein the corner fillers are square tubes which abut adjoining rectangular sides of the box form.

22. The box form for forming a concrete integral box shaped module according to claim 16 wherein the corner fillers are steel.

23. The box form for forming a concrete integral box shaped module according to claim 16 wherein the corner fillers are plastic.

24. The box form for forming a concrete integral box shaped module according to claim 16 wherein the bottom trays are removable.

25. The box form for forming a concrete integral box shaped module according to claim 16 including setting screws to position the top trays in the exact same position before forming a module.

26. A box form as claimed in claim 16 wherein the corner fillers are dimensioned to extend above the module and include lifting connections to permit lifting of the module from the form.

* * * * *